US009500104B2

(12) United States Patent
Choi

(10) Patent No.: US 9,500,104 B2
(45) **Date of Patent: *Nov. 22, 2016**

(54) VARIABLE VALVE LIFT APPARATUS

(71) Applicant: Hyundai Motor Company, Seoul (KR)

(72) Inventor: Byongyoung Choi, Bucheon-si (KR)

(73) Assignee: Hyundai Motor Company, Seoul (KR)

( * ) Notice: Subject to any disclaimer, the term of this patent is extended or adjusted under 35 U.S.C. 154(b) by 71 days.

This patent is subject to a terminal disclaimer.

(21) Appl. No.: 14/555,332

(22) Filed: Nov. 26, 2014

(65) Prior Publication Data

US 2016/0090875 A1 Mar. 31, 2016

(30) Foreign Application Priority Data

Sep. 30, 2014 (KR) ..... 10-2014-0131637

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 9/04*** | (2006.01) |

(52) U.S. Cl.

CPC ..... *F01L 1/344* (2013.01); *F01L 1/047* (2013.01); *F01L 9/04* (2013.01)

(58) Field of Classification Search

CPC ..... F01L 1/344; F01L 1/047; F01L 9/04
USPC ..... 123/90.18, 90.11, 90.6
See application file for complete search history.

(56) References Cited

U.S. PATENT DOCUMENTS 7,409,938 B2 * 8/2008 Dengler ..... F01L 1/08 123/90.15

(Continued)

FOREIGN PATENT DOCUMENTS

DE 102011018503 A 10/2012
JP 2007-56777 A 3/2007

(Continued)

OTHER PUBLICATIONS

Schoeneberg et al., Valve Drive for Gas Exchange Valves of an Internal Combustion Engine, Comprising an Axially Movable Bearing, US Patent Application Pub. US2010/0175652, Jul. 15, 2010.*

*Primary Examiner* — Ching Chang
(74) *Attorney, Agent, or Firm* — Morgan, Lewis & Bockius LLP

(57) ABSTRACT

A variable value lift apparatus may include a camshaft, a first moving cam including cams having different shapes, having a first cam guide protrusion, rotating with the camshaft, and being slidable in an axial direction of the camshaft, a second moving cam including cams having different shapes, having a second cam guide protrusion, rotating together with the camshaft, and being slidable in the axial direction of the camshaft, a first operating unit selectively jutting out to guide the first cam guide protrusion to move the first moving cam in a first direction, a second operating unit selectively jutting out to guide the second cam guide protrusion to move the second moving cam in a second direction, a controller to control operations of the first and second operating units, and valve opening and closing units brought into contact with any one of the plurality cams to be opened and closed.

10 Claims, 7 Drawing Sheets

(56) References Cited

U.S. PATENT DOCUMENTS

| | | | | |
|---|---|---|---|---|
| 8,899,196 | B2 * | 12/2014 | Choi | F01L 1/34 123/90.16 |
| 9,004,031 | B1 * | 4/2015 | Choi | F01L 13/0036 123/90.16 |
| 9,010,290 | B2 * | 4/2015 | Choi | F01L 13/0042 123/90.16 |
| 9,057,293 | B2 * | 6/2015 | Choi | F01L 13/0042 |
| 9,140,147 | B2 * | 9/2015 | Woo | F01L 1/047 |

FOREIGN PATENT DOCUMENTS

| | | | |
|---|---|---|---|
| JP | 5028355 | B2 | 9/2012 |
| JP | 5264787 | B2 | 8/2013 |
| JP | 2013-249827 | A | 12/2013 |
| KR | 10-0633925 | B1 | 10/2006 |
| KR | 10-1438622 | B1 | 9/2014 |
| WO | WO 2012/146361 | A1 | 11/2012 |

* cited by examiner

VARIABLE VALVE LIFT APPARATUS

CROSS-REFERENCE TO RELATED APPLICATION

The present application claims priority to and the benefit of Korean Patent Application No. 10-2014-0131637 filed on Sep. 30, 2014, the entire contents of which is incorporated herein for all purposes by this reference.

BACKGROUND OF THE INVENTION

Field of the Invention

The present invention relates to a variable valve lift apparatus, and more particularly, to a variable valve lift apparatus capable of implementing a plurality of valve lift modes through a simple configuration.

Description of Related Art

An internal combustion engine receives fuel and air into a combustion chamber and burns the same to generate power. When taking in air, an intake valve is operated by driving of a camshaft, and while the intake valve is open, air is taken into the combustion chamber. Also, an exhaust valve is operated by driving of the camshaft, and while the exhaust valve is open, air is discharged from the combustion chamber.

Here, however, optimal intake valve and exhaust valve operations are varied depending on a rotation speed of an engine. That is, an appropriate lift or valve opening/closing time is varied depending on a rotation speed of the engine. In order to implement appropriate valve operations according to rotation speeds of an engine, a variable valve lift (VVL) apparatus including a plurality of cams designed to have various shapes and driving valves to be operated at different lifts according to RPMs of an engine has been studied.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve lift apparatus having advantages of implementing a plurality of valve lift modes through a simple configuration.

An aspect of the present invention provides a variable value lift apparatus including a camshaft, a first moving cam including a plurality of cams having different shapes, having a first cam guide protrusion, rotating together with the camshaft, and being slidable in an axial direction of the camshaft, a second moving cam including a plurality of cams having different shapes, having a second cam guide protrusion, rotating together with the camshaft, and being slidable in the axial direction of the camshaft, a first operating unit selectively jutting out to guide the first cam guide protrusion to move the first moving cam in a first direction, a second operating unit selectively jutting out to guide the second cam guide protrusion to move the second moving cam in a second direction, a controller configured to control operations of the first operating unit and the second operating unit, and valve opening and closing units brought into contact with any one of the plurality of cams so as to be opened and closed.

The first cam guide protrusion and the second cam guide protrusion may be formed in opposite directions in order to move the first moving cam and the second moving cam in the first direction and the second direction, respectively.

The first moving cam and the second moving cam may be connected with each other and move together.

Each of the first and second operating units may include first and second solenoids actuated under control of the controller, and first and second guide parts jutting out by the first and second solenoids and allowing the first and second cam guide protrusions to be inserted therein, in order to move the first and second moving cams, respectively.

Each of the first and second operating units may further include a pin housing, wherein each of the first and second guide parts may include main pins rotatably provided in the pin housing and jutting out according to actuations of the first and second solenoids, and subordinate pins rotatably provided in the pin housing and engaged with the main pins so as to jut out together with the main pins.

A guide groove may be formed in any one of the main pins and the subordinate pins, and a guide protrusion may be formed in the other of the main pins and the subordinate pins and inserted into the guide groove.

Sloped portions may be formed in the first and second moving cams, respectively, to allow the first and second guide parts to return to their original positions after the first and second moving cams are moved.

The variable value lift apparatus may further include a stopper unit, wherein a stopper groove may be formed between the first moving cam and the second moving cam, and the stopper unit may be inserted into the stopper groove such that the first moving cam and the second moving cam stably rotate after movement.

The stopper unit may include a stopper body, a stopper ball inserted into the stopper groove, and an elastic member provided within the stopper body to elastically support the stopper ball.

Another embodiment of the present invention provides a variable valve lift apparatus including a camshaft, a moving cam including a plurality of cams having different shapes, having first and second cam guide protrusions, rotating together with the camshaft, and being slidable in an axial direction of the camshaft, first and second operating units selectively jutting out to guide the first and second cam guide protrusions to move the moving cam in a first direction or a second direction, a controller configured to control operations of the first operating unit and the second operating unit, and valve opening and closing units brought into contact with any one of the plurality of cams so as to be opened and closed.

The first cam guide protrusion and the second cam guide protrusion may be formed in opposite directions in order to move the moving cam in the first direction or the second direction.

Each of the first and second operating units may include first and second solenoids actuated under control of the controller, and first and second guide parts jutting out by the first and second solenoids and allowing the first and second cam guide protrusions to be inserted therein, in order to move the first and second moving cams, respectively.

Each of the first and second operating units may further include a pin housing, wherein each of the first and second guide parts may include main pins rotatably provided in the pin housing and jutting out according to actuations of the first and second solenoids, and subordinate pins rotatably provided in the pin housing and engaged with main pins so as to jut out together with the main pins.

A guide groove may be formed in any one of the main pins and the subordinate pins, and a guide protrusion may be formed in the other of the main pins and the subordinate pins and inserted into the guide groove.

Sloped portions may be formed in the first and second moving cams, respectively, to allow the first and second guide parts to return to their original positions after the first and second moving cams are moved.

A movement stopper groove is formed between the first and second cam guide protrusions, and the variable valve lift apparatus may further include a stopper unit including a stopper body, a stopper ball inserted into the stopper groove, and an elastic member provided within the stopper body to elastically support the stopper ball, wherein the stopper unit is inserted into the stopper groove such that the moving cam stably rotates after movement.

According to the variable valve lift apparatus of an exemplary embodiment of the present invention, a plurality of valve lift modes can be implemented through a simple configuration.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
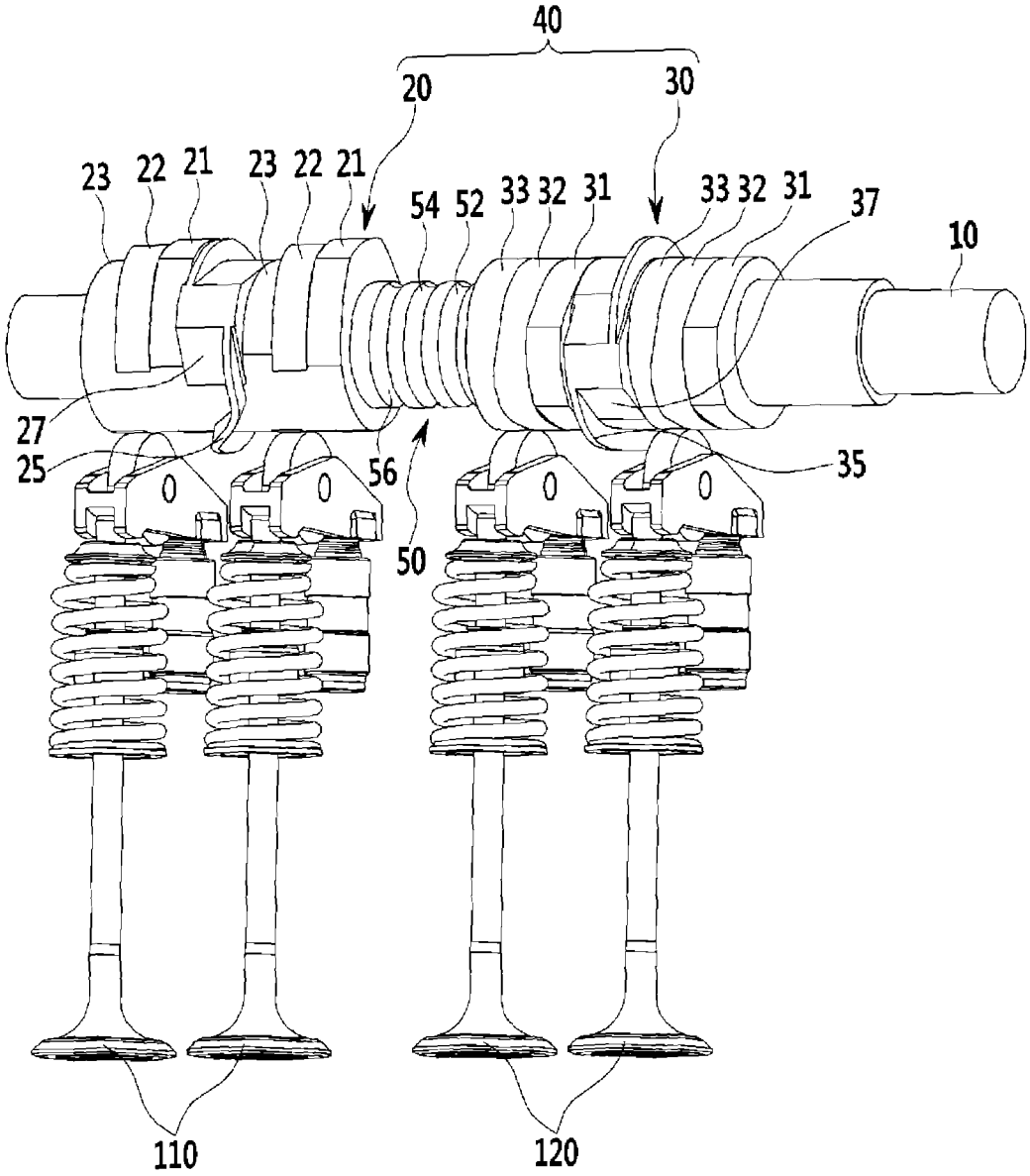
FIG. 1 is a perspective view illustrating a variable value lift apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Throughout the specification, like numbers refer to like elements.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification, unless explicitly described to the contrary, the word "comprise" and variations such as "comprises" or "comprising" will be understood to imply the inclusion of stated elements but not the exclusion of any other elements.

An exemplary embodiment of the present invention will hereinafter be described in detail with reference to the accompanying drawings.

Figure 2:
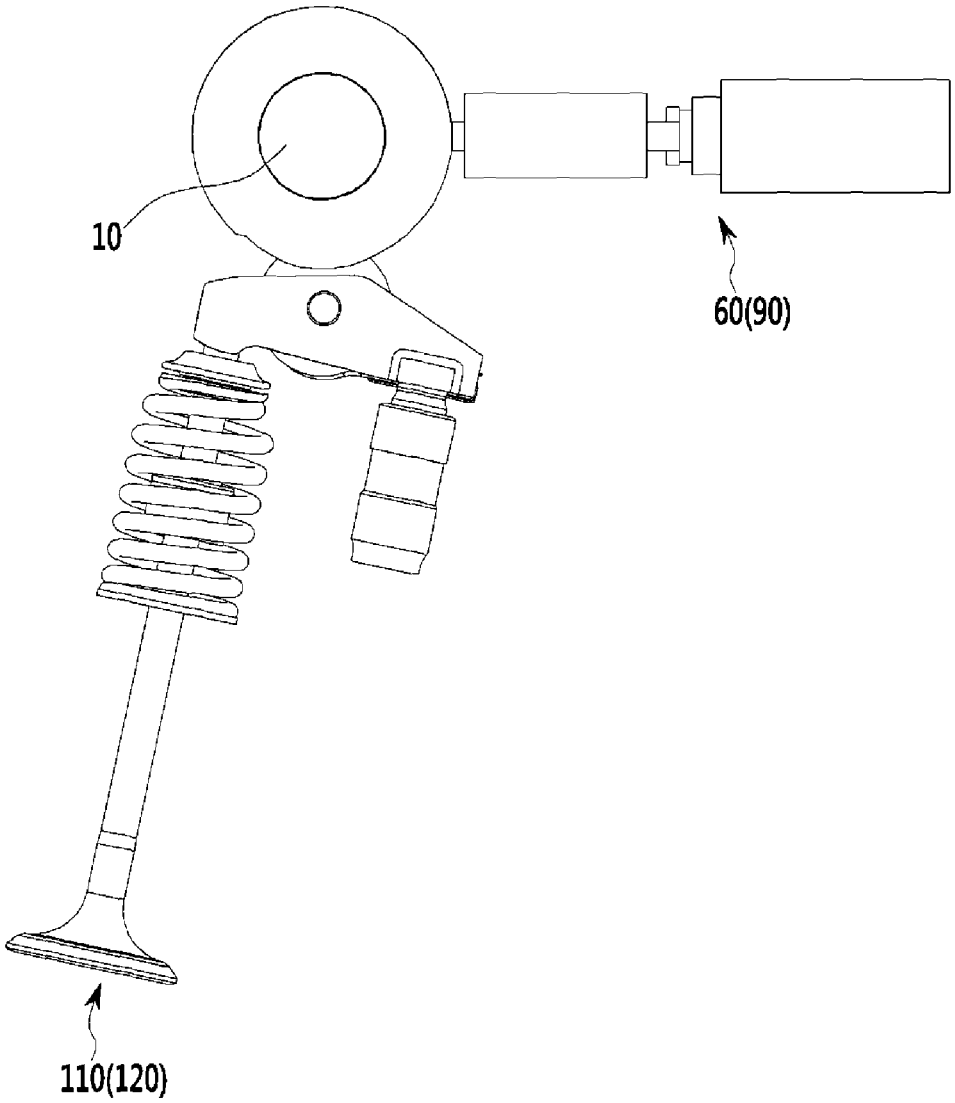
FIG. 2 is a side view of the variable value lift apparatus according to an exemplary embodiment of the present invention.

FIG. 1 is a perspective view illustrating a variable value lift apparatus according to an exemplary embodiment of the present invention, and FIG. 2 is a side view of the variable value lift apparatus according to an exemplary embodiment of the present invention.

Figure 3:
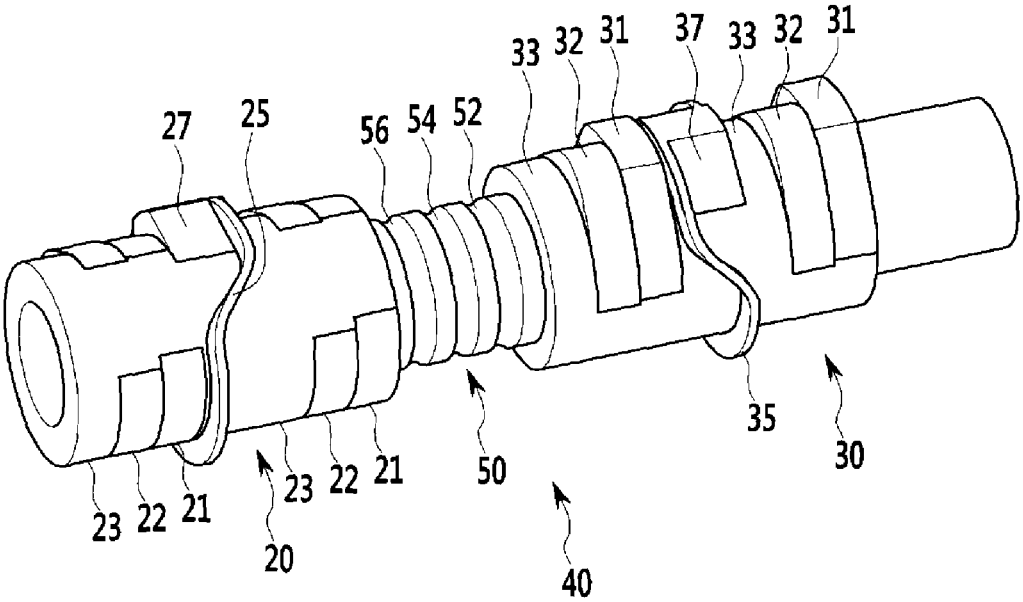
FIG. 3 is a perspective view of a moving cam applied to the variable value lift apparatus according to an exemplary embodiment of the present invention.
Figure 4:
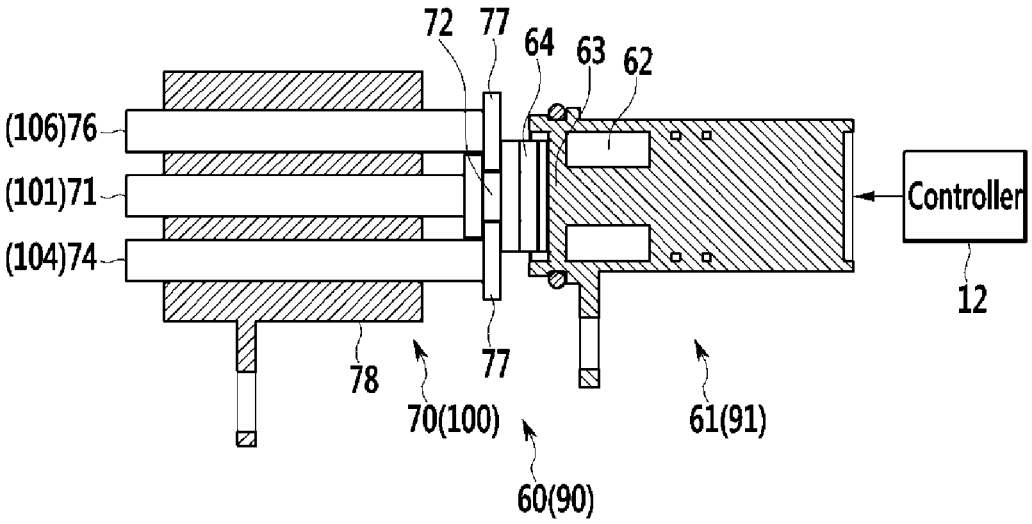
FIG. 4 is a perspective view of an operating unit applied to the variable value lift apparatus according to an exemplary embodiment of the present invention.

FIG. 3 is a perspective view of a moving cam applied to the variable value lift apparatus according to an exemplary embodiment of the present invention, and FIG. 4 is a perspective view of an operating unit applied to the variable value lift apparatus according to an exemplary embodiment of the present invention.

Referring to FIGS. 1 through 4, a variable value lift apparatus according to an exemplary embodiment of the present invention includes a camshaft 10, a first moving cam 20 including a plurality of cams 21, 22, and 23 having different shapes, having a first cam guide protrusion 25, rotating together with the camshaft 10, and being slidable in an axial direction of the camshaft 10, a second moving cam 30 including a plurality of cams 31, 32, and 33 having different shapes, having a second cam guide protrusion 35, rotating together with the camshaft 10, and being slidable in the axial direction of the camshaft 10, a first operating unit 60 selectively jutting out to guide the first cam guide protrusion 25 to move the first moving cam 20 in a first direction, a second operating unit 90 selectively jutting out to guide the second cam guide protrusion 35 to move the second moving cam 30 in a second direction, a controller 12 configured to control operations of the first operating unit 60 and the second operating unit 90, and valve opening and closing units 110 and 120 brought into contact with any one of the plurality of cams 21, 22, 23, 31, 32, and 33 so as to be opened and closed.

It is illustrated that the first moving cam 20 and the second moving cam 30 include three cams 21, 22, and 23, and 31, 32, and 33, respectively, but the present invention is not limited thereto, and the first moving cam 20 and the second moving cam 30 may have various numbers of cams.

The plurality of cams 21, 22, 23, 31, 32, and 33 may be disposed in order, sequentially starting from that having the largest valve profile, and any one of the cams, for example, the cams 23 and 33 may be cylinder deactivation cams having a cam lift of 0.

The first cam guide protrusion 25 and the second cam guide protrusion 35 are formed in the opposite directions in order to move the first moving cam 20 and the second moving cam 30 in the first direction and the second direction, respectively. For example, the first cam guide protrusion 25 may move the first moving cam 20 to the left in the drawing, and the second cam guide 35 may move the second moving cam 30 to the right.

The first and second operating units 60 and 90 include first and second solenoids 61 and 91 actuated under the control of the controller 12, and first and second guide parts 70 and 100 jutting out by the first and second solenoids 61 and 91 and allowing the first and second cam guide protrusions 25 and 35 to be inserted therein, respectively, in order to move the first and second moving cams 20 and 30.

The first and second operating units 60 and 90 further include a pin housing 78, respectively, the first and second guide parts 70 and 100 further include main pins 71 and 101 rotatably provided in the pin housing 78 and jutting out according to actuations of the first and second solenoids 61 and 91, and subordinate pins 74, 76, 104, and 106 rotatably provided in the pin housing 78 and engaged with the main pins 71 and 101 so as to jut out together with the main pins 71 and 101.

The first and second solenoids 61 and 91 include a coil 62, a core 63, and a magnet 64, respectively, and when the main pins 71 and 101 are pushed according to a signal from the controller 12, the main pins 71 and 101 and the subordinate pins 74, 76, 104, and 106 jut out simultaneously.

In the drawing, the main pins 71 and 101 and the subordinate pins 74, 76, 104, and 106 engaged with the main pins 71 and 101 are illustrated, but the present invention is not limited thereto, and the main pins and the subordinate pins may be provided in proportion to the number of the plurality of cams 21, 22, 23, 31, 32, and 33.

A guide groove 72 is formed in any one of the main pins 71 and 101 and the subordinate pins 74, 76, 104, and 106, and a guide protrusion 77 is formed in the other of the main pins 71 and 101 and the subordinate pins 74, 76, 104, and 106 and inserted into the guide groove 72.

In the drawings, it is illustrated that the guide groove 72 is formed in the main pins 71 and 101 and the guide protrusion 77 is formed in the subordinate pins 74, 76, 104, and 106, but the present invention is not limited thereto, and a vice versa arrangement is also possible.

Sloped portions 27 and 37 may be formed in the first and second moving cams 20 and 30, respectively, to allow the first and second guide parts 70 and 100 to return to their original positions after the first and second moving cams 20 and 30 are moved.

The first moving cam 20 and the second moving cam 30 may be connected to integrally move, and the first moving cam 20 and the second moving cam 30 may be integrally formed as a single moving cam 40. That is, the first cam guide protrusion 25 and the second cam guide protrusion 35 may move the moving cam 40 in the first direction or the second direction.

When the main pins 71 and 101 and the subordinate pins 74, 76, 104, and 106 jut out so the first and second cam guide protrusions 25 and 35 are inserted between the main pins 71 and 101 and the subordinate pins 74, 76, 104, and 106, the first moving cam 20 and the second moving cam 30, or the moving cam 40, move in an axial direction of the camshaft 10, and the main pins 71 and 101 and the subordinate pins 74, 76, 104, and 106 may move along the sloped portions 27 and 37 so as to return to their original positions.

The variable valve lift apparatus may further include a stopper unit 80, and a stopper groove 50 may be formed between the first moving cam 20 and the second moving cam 30. The stopper unit 80 is inserted into the stopper groove 50 such that the first moving cam 20 and the second moving cam 30, or the moving cam 40, may stably rotate after movement.

The stopper unit 80 includes a stopper body 82, a stopper ball 84 inserted into the stopper groove 50, and an elastic member 86 provided within the stopper body 82 to elastically support the stopper ball 50.

Figure 5:
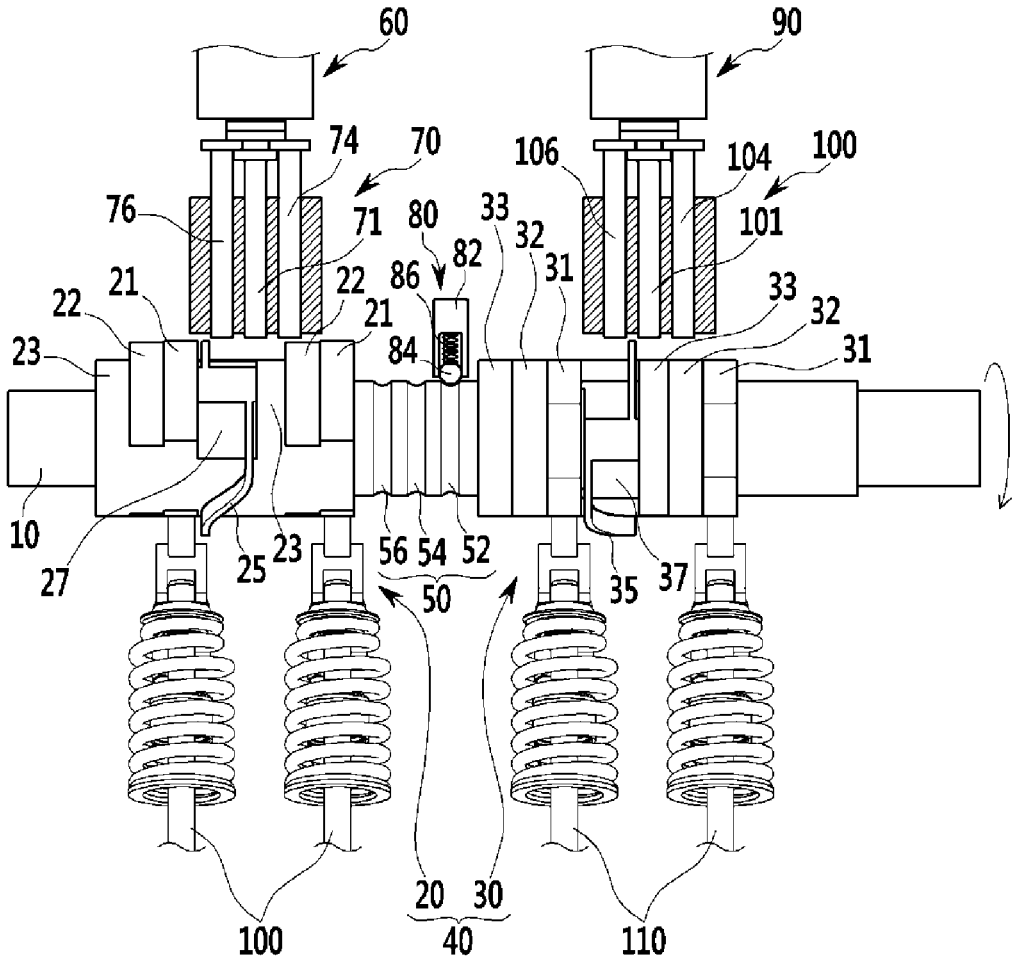
FIG. 5, FIG. 6 and FIG. 7 are views illustrating an operation of the variable value lift apparatus according to an exemplary embodiment of the present invention.
Figure 6:
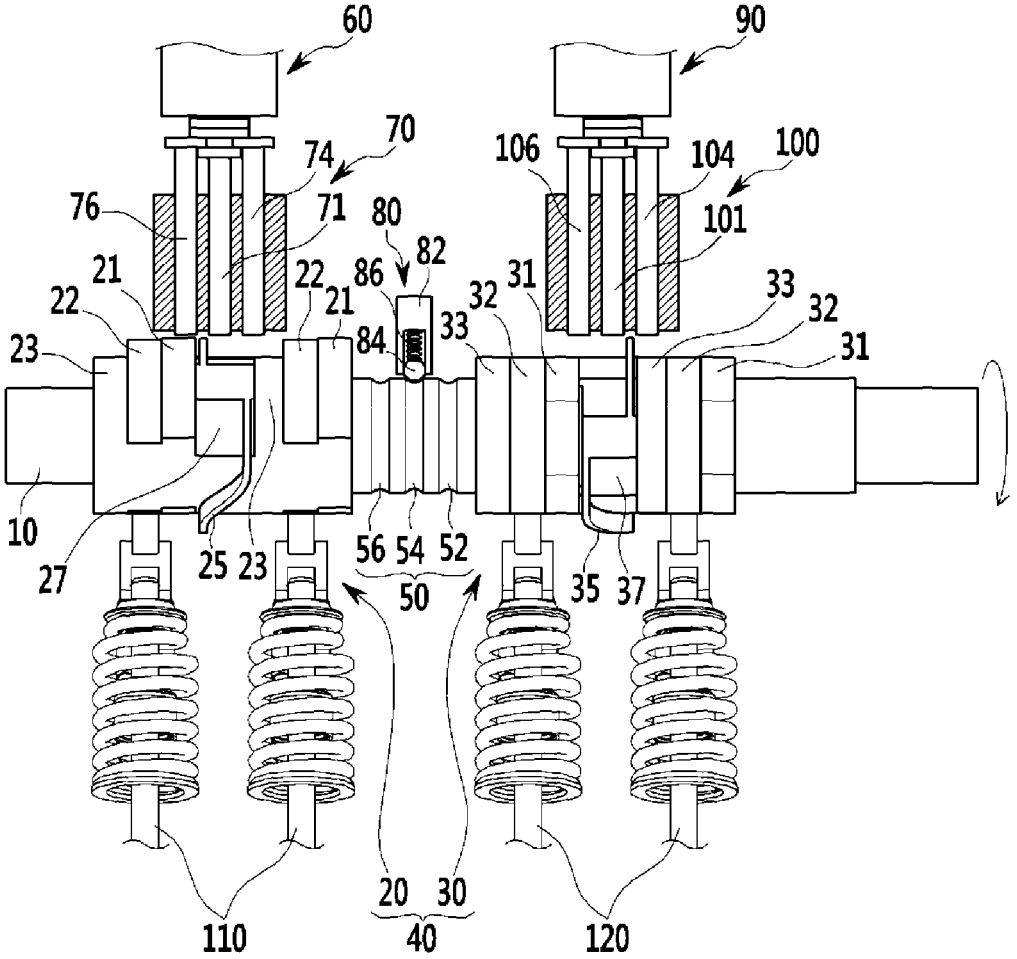
Figure 7:
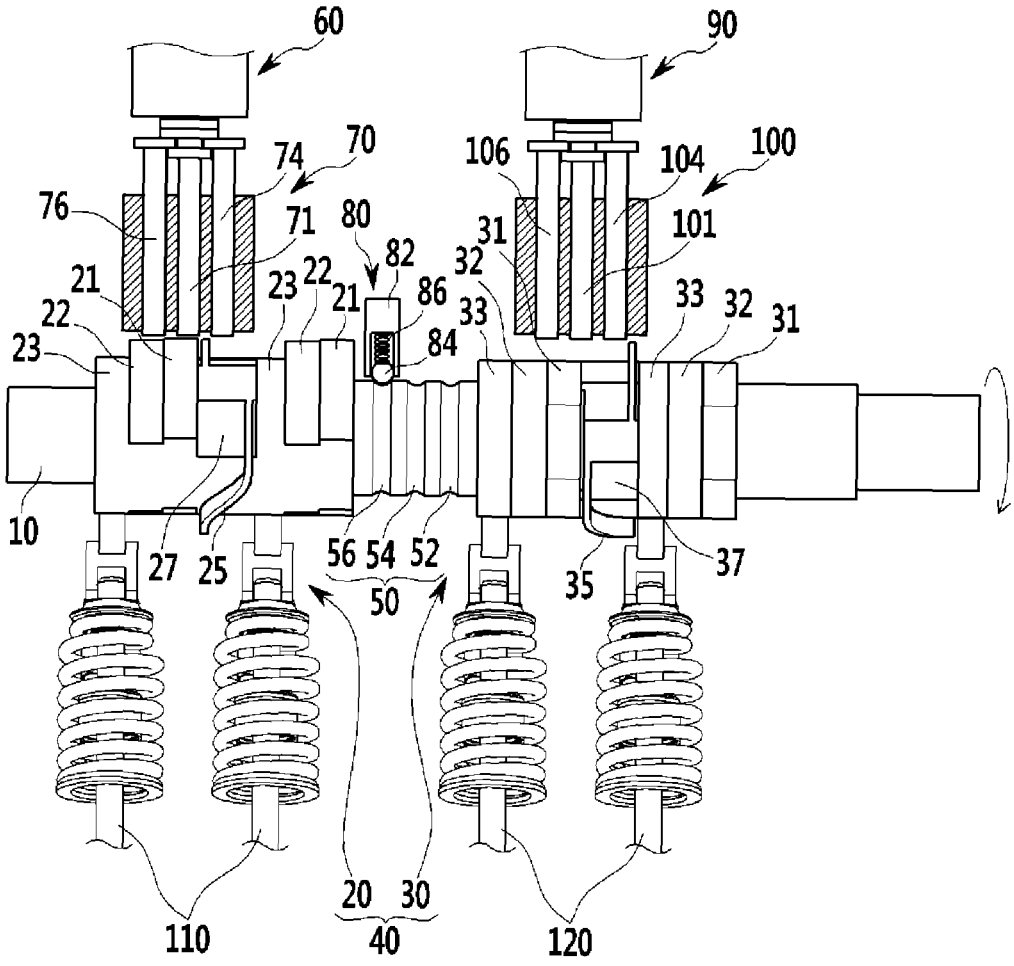

FIGS. 5 through 7 are views illustrating an operation of the variable value lift apparatus according to an exemplary embodiment of the present invention.

Hereinafter, an operation of the variable valve lift apparatus according to an exemplary embodiment of the present invention will be described with reference to FIGS. 5 through 7.

As illustrated in FIG. 5, in a state in which the stopper ball 84 is inserted into a right groove 52 and the valve opening and closing units 110 and 120 are in contact with the right cams 21 and 31 among the cams, when a load of an engine is reduced, the controller 12 operates the second operating unit 90 and the second guide part 100 juts out. Then, the second cam guide protrusion 35 is insertedly guided between the main pin 101 and the left subordinate pin 106 of the second guide part 100. Then, as illustrated in FIG. 6, the second moving cam 30 and the first moving cam 20 move to the right in the drawing, the stopper ball 84 is inserted into a middle groove 54, and the valve opening and closing units 110 and 120 come into contact with the middle cams 22 and 32 among the cams so as to be opened and closed. Through this process, the valve lift is varied. The second guide part 100 returns to its original position by the sloped portion 37 formed in the second moving cam 30.

In the state illustrated in FIG. 6, when the load of the engine is further reduced, the controller 12 operates the second operating unit 90 and the second guide part 100 juts out. Then, the second cam guide protrusion 35 is insertedly guided between the main pin 101 and the right subordinate pin 104 of the second guide part 100. Subsequently, as illustrated in FIG. 7, the second moving cam 30 and the first moving cam 20 move to the right in the drawing, the stopper ball 84 is inserted into a left groove 56, and the valve opening and closing units 110 and 120 come into contact with the left cams 23 and 33 among the cams so as to be opened and closed. Through this process, the valve lift is varied. The second guide part 100 returns to its original position by the sloped portion 37 formed in the second moving cam 30.

When the load of the engine is increased, the controller 12 operates the first operating unit 60 and the first guide part 100 juts out. A movement of the moving cam 40 according to the jutting of the first guide part 100 and a change in the valve lift are similar to those described above, and thus a detailed description thereof will be omitted.

In general, a space between cams is limited, but in the variable valve lift apparatus according to an exemplary embodiment of the present invention, the first cam guide protrusion 25 and the second cam guide protrusion 35 have a plate shape, thus overcoming restrictions with respect to the axial directional space of the camshaft 10.

The variable value lift apparatus according to an exemplary embodiment of the present invention has a smaller amount of components, reducing manufacturing cost.

The variable value lift apparatus according to an exemplary embodiment of the present invention does not use hydraulic pressure, and thus a load of an engine can be reduced, improving fuel efficiency.

The variable value lift apparatus according to an exemplary embodiment of the present invention has a plurality of cams, implementing a valve profile of three stages or greater.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A variable valve lift apparatus comprising:

a camshaft;

a first moving cam including a plurality of cams having different shapes, having a first cam guide protrusion, rotating together with the camshaft, and being slidable in an axial direction of the camshaft;

a second moving cam including a plurality of cams having different shapes, having a second cam guide protrusion, rotating together with the camshaft, and being slidable in the axial direction of the camshaft;

a first operating device selectively extending out to guide the first cam guide protrusion to move the first moving cam in a first direction;

a second operating device selectively extending out to guide the second cam guide protrusion to move the second moving cam in a second direction;

a controller controlling operations of the first operating device and the second operating device; and valve opening and closing devices brought into contact with one of the plurality cams so that the valve opening and closing devices are selectively opened or closed, wherein the first cam guide protrusion and the second cam guide protrusion are positioned in opposite directions to move the first moving cam and the second moving cam in the first direction and the second direction, respectively, wherein each of the first and second operating devices comprises:

first and second solenoids actuated under control of the controller; and first and second guide parts extending out by the first and second solenoids and allowing the first and second cam guide protrusions to be inserted therein, to move the first and second moving cams, respectively, and wherein each of the first and second operating devices further comprises a pin housing, and wherein each of the first and second guide parts comprises:

main pins rotatably disposed in the pin housing and extending out according to actuations of the first and second solenoids; and subordinate pins rotatably disposed in the pin housing and engaged with the main pins to extend out together with the main pins.

2. The variable valve lift apparatus of claim 1, wherein the first moving cam and the second moving cam are connected with each other and move together.

3. The variable valve lift apparatus of claim 1, wherein a guide groove is formed in one of the main pins and the subordinate pins, and a guide protrusion is formed in another of the main pins and the subordinate pins and inserted into the guide groove.

4. The variable valve lift apparatus of claim 1, wherein sloped portions are formed in the first and second moving cams, respectively, to allow the first and second guide parts to return to original positions thereof after the first and second moving cams are moved.

5. The variable valve lift apparatus of claim 1, further comprising a stopper device, wherein a stopper groove is formed between the first moving cam and the second moving cam, and wherein the stopper device is inserted into the stopper groove such that the first moving cam and the second moving cam stably rotate after movement.

6. The variable valve lift apparatus of claim 5, wherein the stopper device comprises:

a stopper body;

a stopper ball inserted into the stopper groove; and an elastic member provided within the stopper body to elastically support the stopper ball.

7. A variable valve lift apparatus comprising:

a camshaft;

a moving cam including a plurality of cams having different shapes, having first and second cam guide protrusions, rotating together with the camshaft, and being slidable in an axial direction of the camshaft;

first and second operating devices selectively extending out to guide the first and second cam guide protrusions to move the moving cam in a first direction or a second direction;

a controller controlling operations of the first operating device and the second operating device; and valve opening and closing devices brought into contact with one of the plurality cams so that the valve opening and closing devices are selectively opened or closed, wherein the first cam guide protrusion and the second cam guide protrusion are positioned in opposite directions to move the moving cam in the first direction or the second direction, wherein each of the first and second operating devices comprises:

first and second solenoids actuated under control of the controller; and first and second guide parts extending out by the first and second solenoids and allowing the first and second cam guide protrusions to be inserted therein, to move the first and second moving cams, respectively, wherein each of the first and second operating devices further comprises a pin housing, and wherein each of the first and second guide parts comprises:

main pins rotatably positioned in the pin housing and extending out according to actuations of the first and second solenoids; and subordinate pins rotatably positioned in the pin housing and engaged with main pins to extend out together with the main pins.

8. The variable valve lift apparatus of claim 7, wherein a guide groove is formed in one of the main pins and the subordinate pins, and a guide protrusion is formed in another of the main pins and the subordinate pins and inserted into the guide groove.

9. The variable valve lift apparatus of claim 7, wherein sloped portions are formed in the first and second moving cams, respectively, to allow the first and second guide parts to return to original positions thereof after the first and second moving cams are moved.

10. The variable valve lift apparatus of claim 7, wherein a movement stopper groove is formed between the first and second cam guide protrusions, and the variable valve lift apparatus further comprises a stopper device comprising:

a stopper body;

a stopper ball inserted into the stopper groove; and an elastic member provided within the stopper body to elastically support the stopper ball, wherein the stopper device is inserted into the stopper groove such that the moving cam stably rotates after movement.

* * * * *